United States Patent [19]

Shimozi et al.

[11] Patent Number: 4,698,213

[45] Date of Patent: Oct. 6, 1987

[54] EXHAUST GAS PURIFIER WITH RESISTANT CIRCUMFERENTIAL SEALING MEMBER BETWEEN MONOLITH CATALYST AND CASING

[75] Inventors: Kozi Shimozi, Okazaki; Hitoshi Teshima, Aichi, both of Japan

[73] Assignee: Toyota Joshida Kabushiki Kaisha, Aichi, Japan

[21] Appl. No.: 480,813

[22] Filed: Mar. 31, 1983

[30] Foreign Application Priority Data

Sep. 7, 1983 [JP] Japan ..... 57-135590[U]

[51] Int. Cl.[4] ..... B01J 8/00; F01N 3/28

[52] U.S. Cl. ..... 422/179; 422/221

[58] Field of Search ..... 422/179, 180, 221, 222; 60/299; 277/237 R, 26; 502/527; 165/82; 285/176

[56] References Cited

U.S. PATENT DOCUMENTS

| | | | |
|---|---|---|---|
| 3,228,755 | 1/1966 | Lottinville | 422/179 |
| 3,567,403 | 3/1971 | Perga | 422/179 |
| 3,871,340 | 3/1975 | Zimmerman | 123/80 BA |
| 3,912,459 | 10/1975 | Kearsley | 422/179 |
| 3,959,865 | 6/1976 | Close et al. | 422/179 |
| 3,960,510 | 6/1976 | Sergeys | 422/171 |
| 3,963,445 | 6/1976 | Kayama et al. | 422/179 |
| 4,004,887 | 1/1977 | Stormont | 422/179 |
| 4,048,363 | 9/1977 | Langer et al. | 422/179 |
| 4,156,533 | 5/1979 | Close et al. | 277/229 |
| 4,332,267 | 6/1982 | Evans | 137/1 |
| 4,335,077 | 6/1982 | Santiago et al. | 422/179 |
| 4,344,921 | 8/1982 | Santiago et al. | 422/179 |
| 4,444,721 | 4/1984 | Ohkata | 422/179 |
| 4,448,754 | 5/1984 | Isogai et al. | 422/179 |

OTHER PUBLICATIONS

*Research Disclosure* No. 14907, "Method of Assembling Wraps to Exhaust Monoliths", Sep. 1976.

*Primary Examiner*—David L. Lacey
*Attorney, Agent, or Firm*—Kenyon & Kenyon

[57] ABSTRACT

A heat-insulating resilient supporting and sealing member inserted in a monolithic type catalytic exhaust gas purifier of generally elliptical cross section between an inner wall of a casing and the outer periphery of a monolithic catalyst housed in the casing such that a thicker portion of the supporting and sealing member is disposed at a smallest cross dimension region of the casing, and a thinner portion of the supporting and sealing member is disposed at a largest cross dimension region of the casing, so that the bulk density of the member at the operating temperature of the catalytic purifier is approximately constant around the periphery of the member.

9 Claims, 6 Drawing Figures

EXHAUST GAS PURIFIER WITH RESISTANT CIRCUMFERENTIAL SEALING MEMBER BETWEEN MONOLITH CATALYST AND CASING

BACKGROUND OF THE INVENTION

1. Field of the Invention

The present invention relates to a sealing member for use in monolithic type catalytic exhaust gas purifiers and to a catalytic exhaust gas purifier provided with such a sealing member. More specifically, the invention relates to a sealing member made of heat-insulating resilient material for use in a monolithic type catalytic exhaust gas purifier and to a monolithic type catalytic exhaust gas purifier having such a sealing member.

2. Prior Art

In the conventional monolithic type catalytic exhaust gas purifier containing a monolithic catalyst in a casing, a woven fabric of metal, or a heat-insulating material such as ceramic fiber, or the like for supporting and sealing the catalyst is inserted into a space defined by an inner wall of the casing and the outer periphery of the monolithic catalyst.

Generally, exhaust gas purifiers in automobiles operate under severe conditions, being subjected at elevated temperature to vibrations of both the automobile bodies and the engines themselves. Consequently, when ceramic fibers are employed in a supporting and sealing member, appropriate selection of the bulk density thereof largely influences the durabiity of the ceramic fiber sealing member. In the case of a flattened cylinder-shaped monolithic type catalytic purifier, the heat expansion rate of the casing in the direction of the larger cross dimension differs from that in the direction of the smaller cross dimension. Specifically, the heat expansion rate in the smaller cross dimension of the casing is far greater than that in the larger cross dimension. This makes it difficult to provide a supporting and sealing ceramic fiber member with an appropriate bulk density. As a result, destruction of the supporting and sealing member, exhaust gas leakage, etc. are caused principally by inappropriate selection of the bulk density of the member.

The present invention provides a solution to the above-mentioned problem.

SUMMARY OF THE INVENTION

An object of the present invention is, therefore, to provide a supporting and sealing member made of heat-insulating resilient material for use in a monolithic type catalytic exhaust gas purifier, which member is free from the drawbacks encountered with conventional supporting and sealing members, and a monolithic type catalytic exhaust gas purifier including such a supporting and sealing member.

More specifically, the object of the invention is to provide a supporting and sealing member for use in a monolithic type catalytic exhaust gas purifier having a flattened casing with different dimensions in orthogonal directions transverse to the direction of exhaust gas flow, the supporting and sealing member being able to withstand the thermal impact and mechanical vibration of an automobile operating environment with substantially no leakage of the exhaust gas for a prolonged time period.

According to the present invention, the thickness of a heat-insulating resilient supporting and sealing member inserted in a space defined by the inner wall of a flattened-type casing and the outer periphery of a monolithic catalyst installed in the casing is varied between the smallest and largest casing cross dimension directions such that an appropriate balance of the bulk density of the member is maintained around its whole periphery, even when it is subjected to an elevated temperature exhaust gas and is thermally expanded. Namely, according to the present invention, the thickness of the supporting and sealing member in the direction of the smallest cross dimension of the casing is thicker than the average thickness of the member, and the thickness of the supporting and sealing member in the direction of the largest cross dimension of the casing is less than the average thickness of the member so that the balance of the bulk density of the supporting and sealing member may be appropriately maintained over the whole periphery of the member.

BRIEF DESCRIPTION OF THE ATTACHED DRAWINGS

These and other objects and features of the present invention will be better understood from the following description of the invention, taken in conjunction with the attached drawings, in which.

DETAILED DESCRIPTION OF THE PREFERRED EMBODIMENTS

Figure 1:
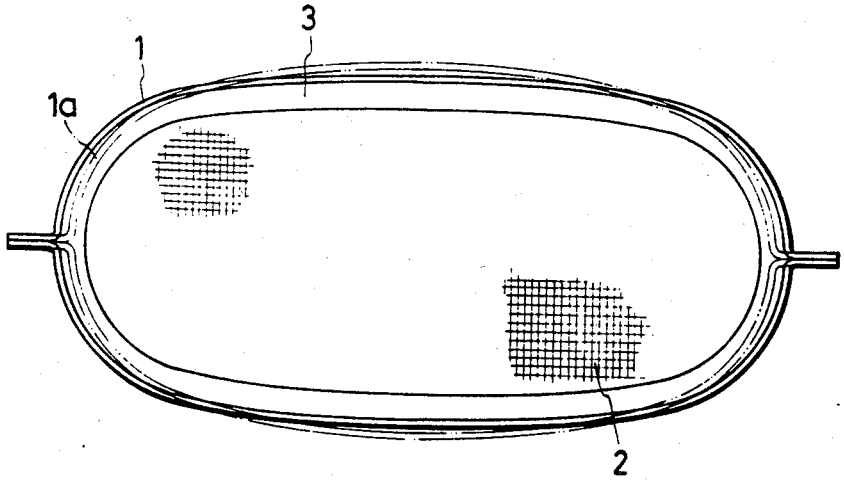
FIG. 1 is a cross-sectional view of a monolithic type catalytic exhaust gas purifier having a flattened casing.

The present invention will be explained in more detail below with reference to the drawings:

FIG. 1 illustrates a sectional view of a monolithic type catalytic exhaust gas purifier having a flattened circular profile in cross section, both in non-heated and heated states, in which a casing 1 houses a monolithic catalyst 2, which is supported therein via a supporting and sealing heat-insulating resilient member 3. The supporting and sealing member 3 is inserted into a space 1' (FIGS. 4 and 5), defined by the inner wall of the casing and the outer peripheral wall of the monolithic catalyst 2, and is composed mainly of heat-insulating resilient material such as ceramic fibers. As seen from FIG. 1, the outer casing has an initial profile at non-heated or ordinary temperature as shown in solid lines 1, but as shown in the two-dot chain lines 1*a*, the casing deforms when heated to be expanded outwardly at the smallest cross dimension, while the casing at the largest cross dimension portion contracts inwardly. Such a phenomenon is inherent in a casing with an elliptical cross-sectional shape.

As mentioned above, the thermal expansion rate of the casing in the smallest cross dimension is greater than that of the casing in the largest cross dimension. In addition, the rigidity in the former direction is less than in the latter. In consequence, the space 1' between the inner wall of the casing and outer peripheral wall of the monolithic catalyst increases in the direction of the smallest cross dimension, causing the bulk density of the portion of the thermal expansible supporting and sealing member 3 in that region to decrease while the bulk density of the supporting and sealing member in the direction of the largest cross dimension of the casing becomes larger. Thus, when the vibrations of the automobile body and the engine are imposed upon the monolithic type catalytic exhaust gas purifier in the heated state, the supporting and sealing member 3 is likely to be broken, allowing exhaust gas leakage to take place.

It is know that, contrary to a woven metal member, a ceramic fiber based sheet member must be prevented from being broken up by the vibrations of the engine body, exhaust gas pulsation, etc., and the bulk density of the ceramic fiber must be appropriately maintained for obtaining durability.

Figure 2:
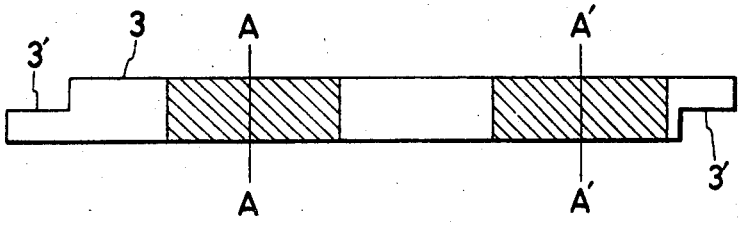
FIG. 2 is a plan view of an unwrapped supporting and sealing member according to the present invention, laid out flat.
Figure 3:
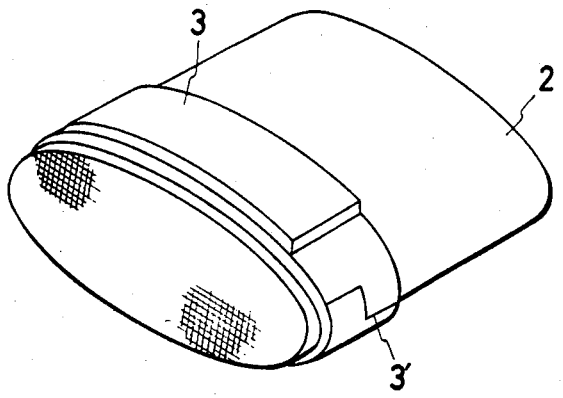
FIG. 3 is a perspective view of a monolithic catalyst around which the supporting and sealing member is wound.
Figure 6:
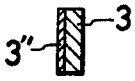
FIG. 6 is a sectional view of another supporting and sealing member according to the present invention.

FIG. 2 is a plan view of one embodiment of a heat-insulating resilient supporting and sealing member according to the present invention. In this embodiment, the thickness of the member at portions located at the smaller cross dimension portions of the casing is greater than that of the supporting and sealing member at the larger cross dimension portions of the casing. The thickness of the member at each portion of its periphery is determined depending upon the thermal expansion rate of the casing at that portion. In FIG. 2, the oblique-lined portions of the supporting and sealing member 3 denote thickened portions corresponding to the regions A—A and A'—A' of smallest cross dimension of the casing, as shown in FIG. 3. The thickened portions may be integrally molded, or as shown in FIG. 6, another thermally expansible piece 3" of predetermined thickness may be integrally attached to a heat-insulating resilient member having a substantially uniform thickness to form the supporting and sealing member according to the present invention.

Figure 4:
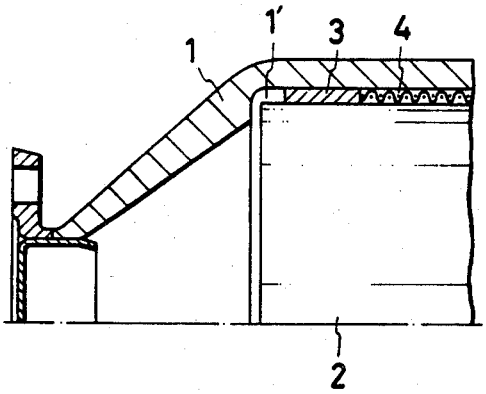
FIG. 4 is a partial longitudinal sectional view of a monolithic type catalytic exhaust gas purifier according to the present invention.
Figure 5:
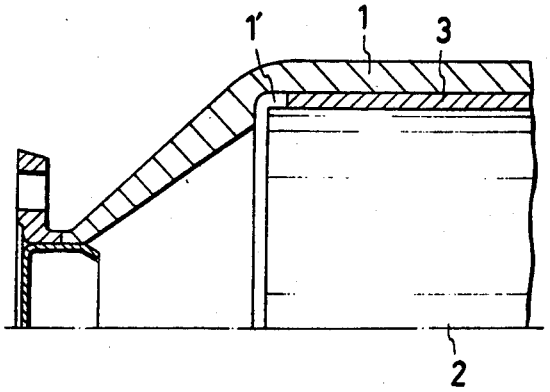
FIG. 5 is a partial longitudinal sectional view of another monolithic type catalytic exhaust gas purifier according to the present invention.

The supporting and sealing member having the above described thickened portions wound around the outer periphery of the monolithic catalyst. As shown in FIGS. 3 and 4, the supporting and sealing heat-insulating resilient member 3 may be wound around the monolithic catalyst at either the exhaust gas inlet end or the exhuast gas outlet end only (FIG. 3) or at both ends. Alternatively, as shown in FIG. 5, the supporting and sealing member according to the present invention may extend over the entire length of the outside periphery of the monolithic catalyst. Further, the supporting and sealing member may be provided around only a part of the length of the outer periphery of the catalyst, whereas a mesh of metal wires 4 as conventionally employed for supporting and sealing the monolithic catalyst within the casing may be provided around the other portions of the outer periphery of the catalyst. Stepped portions 3' are provided at the ends of a supporting and sealing member according to the present invention, as shown in FIGS. 2 and 3, for facilitating wrapping the member around the catalyst. The stepped portions overlap each other in the axial direction, as shown in FIG. 3, to assure continuous coverage of the member around the monolithic catalyst and to absorb the stress on the supporting and sealing member produced by abnormal thermal deformation of the casing.

The ceramic fiber used in the present invention is one conventionally employed. The supporting and sealing member according to the present invention may be made by an appropriate method, such as molding or by pasting ceramic pieces onto a band-like supporting and sealing member substrate.

A monolithic type exhaust gas catalytic purifier according to the present invention may be assembled in the following manner.

First, the supporting and sealing member is wound around the outer periphery of the monolithic catalyst such that the thicker portions of the supporting and sealing member are disposed at the smallest cross dimension of the catalyst, while the thinner portions of the supporting and sealing member are disposed at the largest cross dimension of the catalyst. Then the catalyst provided with the supporting and sealing member, and with metal wire meshes if necessary, is placed in a lower casing member. Next, an upper casing member is sealingly attached to the lower casing member so as to sealingly house the catalyst in the casing, with the supporting and sealing member being slightly compressed.

The thicknesses of the thickened and thinner portions of the supporting and sealing member are determined depending on the size, material, profile, etc. of the casing and catalyst.

As thus constituted, the heat-insulating resilient supporting and sealing member is able to appropriately maintain its bulk density balance over all portions of the member, whereby the problems encountered by the conventional monolithic type catalytic exhaust gas purifier (for example, pulverization of the ceramic fiber supporting and sealing member, exhaust gas leakage, etc.) can be avoided.

Although the purifier in the above embodiments is of the type having an elliptical cross section, the present invention is also applicable to any monolithic type catalyst exhaust gas purifier having a cross dimension in one direction smaller than a cross dimension perpendicular thereto.

Having thus described the present invention, it is to be understood that the invention is not limited to the foregoing, which is given merely for illustration. Changes and variations as can be made by those of oridinary skill in the art to which the invention pertains are considered as falling within the spirit of the invention and the scope of the attached claims.

We claim:

1. A monolithic catalytic exhaust gas purifier for an internal combustion engine, the purifier including a cylindrical sheet metal casing having a longitudinal axis, a first end with an inlet, and a second end opposite the first end with an outlet for respectively introducing exhaust gas into and discharging exhaust gas from the casing, said casing having a flattened cross section transverse to said axis with a minimum cross dimension in one direction and a maximum cross dimension perpendicular to the one direction, a monolithic catalyst housed within the casing, and a supporting and sealing member of heat-insulating resilient material compressed within an annular space defined by the flattened cylindrical wall of the casing and an outer peripheral surface of the catalyst facing the flattened cylindrical wall of the casing, the supporting and sealing member existing completely around said outer peripheral circumference of the catalyst, wherein the improvement comprises:

said monolithic catalyst being cylindrical and having a flattened cross section transverse to the longitudinal axis of the casing and having a minimum cross dimension and a maximum cross dimension; and said supporting and sealing member assembled completely around the catalyst having portions disposed at the minimum cross dimension of the catalyst and having a total thickness greater than the average thickness of the supporting and sealing member and portions disposed at the maximum cross dimension of the catalyst having a total thickness less than the average thickness of the supporting and sealing member, the thicker portions of the supporting and sealing member being disposed at the minimum cross dimension portion of the casing and the thinner portions being disposed at the maximum cross dimension portion of the casing such that the supporting and sealing member will maintain a bulk density balance over all portions of the member around the outer peripheral circumference of said catalyst when the exhaust gas purifier is heated to its normal operating temperature.

2. A catalytic purifier according to claim 1 wherein the flattened cylindrical cross sections of the casing and catalyst are shaped to have elliptical cross sections.

3. A catalytic purifier according to claim 1 wherein the supporting and sealing member is made of ceramic fiber.

4. A catalytic purifier according to claim 1 or 2 or 3 wherein the supporting and sealing member extends along only a part of the entire length of the flattened cylindrical catalyst in the direction of the longitudinal axis of the casing.

5. A catalytic purifier according to claim 13 wherein the supporting and sealing member is disposed completely around at least an end portion of the flattened cylindrical surface of the catalyst adjacent to the first end of the casing.

6. A catalytic purifier according to claim 14 wherein metal wires are disposed around the flattened cylindrical surface of the catalyst at a location other than the end portion around which the supporting and sealing member is disposed.

7. A catalytic purifier according to claim 1 or 2 or 3 wherein the supporting and sealing member comprises a band-like strip having two ends, with stepped portions at both ends which overlap and are bonded together.

8. A catalytic purifier according to claim 1 or 2 or 3 wherein the supporting and sealing member is an integrally molded band.

9. A catalytic purifier according to claim 1 or 2 or 3 wherein the thicker portions of the supporting and sealing member each comprises a piece of sealing material attached onto a band of a substantially constant thickness sealing member which together define said supporting and sealing member.

* * * * *

UNITED STATES PATENT AND TRADEMARK OFFICE

CERTIFICATE OF CORRECTION

PATENT NO. : 4,698,213

DATED : 6 October 1987

INVENTOR(S) : Kozi SHIMOZI et al.

It is certified that error appears in the above-identified patent and that said Letters Patent is hereby corrected as shown below:

ON THE TITLE PAGE,

| | |
|---|---|
| TITLE [54] : | change "RESISTANT" to --RESILIENT--. |
| Column 1, line 2: | change "RESISTANT" to --RESILIENT--. |
| Column 3, line 16: | change "know" to --known--. |
| Column 3, line 44: | change "portions wound" to --portions is wound--. |
| Column 5, line 23: | before "catalyst" insert --the--. |
| Column 6, line 4: | change "claim 13" to --claim 4--. |
| Column 6, line 9: | change "claim 14" to --claim 5--. |

Signed and Sealed this

Fifteenth Day of March, 1988

*Attest:*

*Attesting Officer*

DONALD J. QUIGG

*Commissioner of Patents and Trademarks*